United States Patent [19]

Skach, Jr.

[11] 4,410,356

[45] Oct. 18, 1983

[54] PROCESS FOR PRODUCING SALT-COATED MAGNESIUM GRANULES

[75] Inventor: Edward J. Skach, Jr., Freeport, Tex.

[73] Assignee: The Dow Chemical Company, Midland, Mich.

[21] Appl. No.: 439,700

[22] Filed: Nov. 8, 1982

[51] Int. Cl.[3] ..... B22F 9/08

[52] U.S. Cl. ..... 75/0.5 B; 264/7

[58] Field of Search ..... 75/0.5 B; 264/7

[56] References Cited

U.S. PATENT DOCUMENTS 2,699,576 1/1955 Colbry et al. ..... 75/0.5 B
4,186,000 1/1980 Skach, Jr. et al. ..... 75/0.5 B
4,279,641 7/1981 Skach, Jr. et al. ..... 75/0.5 B
4,331,711 5/1982 Skach, Jr. et al. ..... 75/0.5 B

*Primary Examiner*—W. Stallard
*Attorney, Agent, or Firm*—W. J. Lee

[57] ABSTRACT

Salt-coated Mg granules are prepared by continuously and simultaneously feeding to a mixer a flow of molten Mg and a flow of molten salt at a predetermined ratio to provide up to about 68% molten Mg in the mixture, thereby dispersing the molten Mg as globules in the salt, continuously withdrawing the molten mixture from the mixer at a point distal to that of the feed, freezing the mixture, and milling the frozen mixture to pulverize the salt matrix and recovering salt-coated Mg particles therefrom.

20 Claims, 1 Drawing Figure

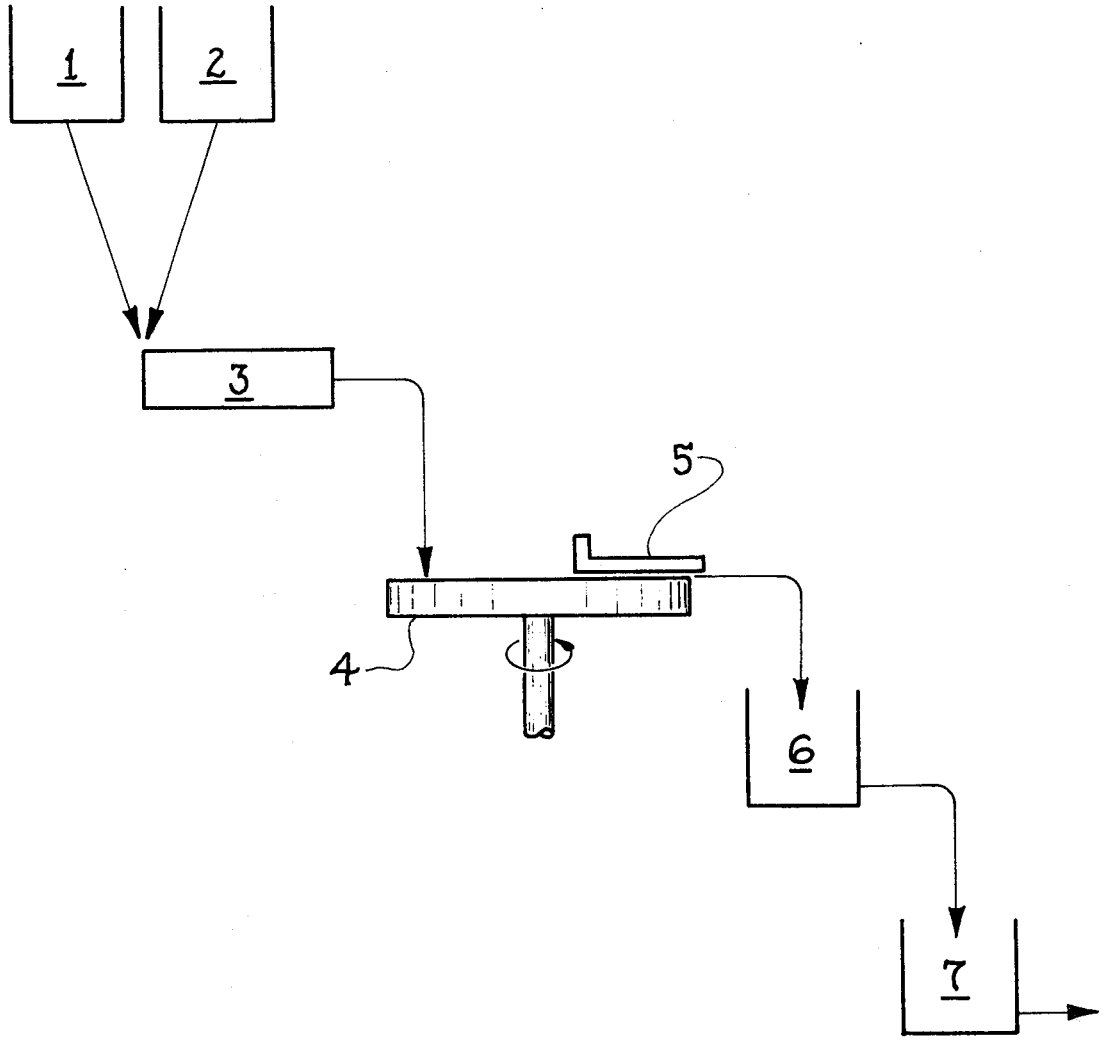
FIGURE

PROCESS FOR PRODUCING SALT-COATED MAGNESIUM GRANULES

BACKGROUND OF THE INVENTION

Various methods for producing useful salt-coated magnesium granules have been proposed. For example, U.S. Pat. No. 3,881,913 and U.S. Pat. No. 3,969,104 disclose a centrifugal atomization technique.

U.S. Pat. No. 4,186,000 and U.S. Pat. No. 4,279,641 are closely related in subject matter to the present invention. They disclose a melt of a salt-containing composition in which up to about 42% of molten magnesium or magnesium alloy is dispersed with stirring, then the dispersion is cooled to form a frozen friable salt matrix composition containing frozen Mg or Mg alloy granules dispersed therein. The Mg or Mg alloy granules, still coated with a thin coating of the salt mixture, are separated by physical methods from entrapment in the friable salt matrix. These patents are incorporated herein by reference.

It is an object of the present invention to provide improvements in the process of dispersing molten Mg or Mg alloy in a molten salt-containing composition whereby the mixture, when frozen, contains a beneficially greater percent by weight of the Mg or Mg alloy granules.

Another object is the preparation of a friable salt matrix containing dispersed therein Mg or Mg alloy granules in improved amounts whereby there is a lesser quantity of salt requiring recycle or disposal when the friable salt matrix is pulverized to free the Mg or Mg alloy granules dispersed therein.

SUMMARY OF THE INVENTION

A molten mixture of a salt-containing composition and Mg or Mg alloy, wherein the Mg or Mg alloy comprises up to about 68% by weight of the total, is prepared on a continuous basis, with stirring, the molten mixture from the stirred vessel being rapidly chilled to freezing on a cooled surface thereby producing Mg or Mg alloy granules dispersed in a friable salt matrix. The frozen matrix may then be broken up by physical methods to obtain salt-coated Mg or Mg alloy granules from entrapment in the pulverized salt-containing matrix.

DETAILED DESCRIPTION OF THE INVENTION

A FIGURE is attached hereto to depict a flow diagram as a visual aid in describing certain embodiments of the present invention.

The salt-containing composition may be any of those already known to form useful protective coatings on Mg or Mg alloy granules, such as those described in the patents named above. Furthermore, the salt-containing compositions (also called "matrix compositions" here) may contain substantial amounts of finely-divided insoluble (non-melted) ingredients such as MgO or other oxides or compounds which are not melted at the temperatures employed here. The specific gravity of the molten matrix may be more or less than the specific gravity of the molten Mg or Mg alloy or may be substantially equal. The present process substantially avoids the deleterious formation of clusters of Mg particles during the cooling step; such deleterious formation of clusters is stated in U.S. Pat. No. 4,186,000 and U.S. Pat. No. 4,279,641 as being the reason for not exceeding 42% Mg, by weight, in the molten mixture.

The Mg or Mg alloy may contain ingredients or impurities which, beneficially, may be substantially taken up by the molten matrix which may contain fluxing agents suitable therefor.

The Mg alloys are predominantly Mg with minor amounts of alloyed metals, e.g., aluminum, copper, manganese, vanadium, and the like. The desirability or non-desirability of having a particular alloyed metal in the Mg is decided more by the end-use for the salt-coated granule than by the capability of the present process.

THE PROCESS IN GENERAL

In general, the process involves continuously feeding the Mg metal and salt-containing composition to a stirred vessel, the temperature being sufficient to provide the mixture as a molten, stirable mass, while continuously removing the molten mass from a position in the vessel which is distal from the feed position. The molten mass taken from the stirred vessel is continuously applied to a cooled surface to cause the molten mixture to freeze, thereby obtaining small frozen metal granules entrapped in a frozen friable matrix. Preferably the cooled surface is a moving surface, such as a revolving drum, rotary table, or "endless" metal sheet in order that a relatively thin laydown of the melt is obtained, thereby obtaining rapid heat-transfer from the melt.

The stirring of the molten mixture in the mixing vessel may be accomplished by using stirring paddles or blades, or may be accomplished by using in-line static mixers which comprise a plurality of fixed blades or fluid dividers which provide numerous divisions and recombinations of fluids flowing therethrough. Such static mixers are well known and are sometimes referred to as "interfacial surface generators". Among the many publications disclosing such static mixers and patents therefore is, e.g., an article on page 94 of the May 19, 1969 issue of Chemical Engineering. Selection of the static mixer for use in the present invention should be made in view of the high temperature and corrosiveness of the molten mixture involved.

In preparing stirred mixtures of molten Mg (or Mg alloy) and molten salt so as to form globules of the molten Mg dispersed in the continuous molten salt phase, there appears to be a maximum content of Mg which can be used without having some of the globules of Mg flow back together before they become frozen during the interval after stirring, but during cooling. When some of the globules flow back together, they can coalesce to form larger particles than desired or can form clusters of particles. This coalescing or clustering of particles is counterproductive when the object of performing the process is to form substantially spherical, discrete particles within a given particle size range. This clustering or coalescing of molten particles is referred to in U.S. Pat. No. 4,186,000 as being the reason for limiting the amount of Mg or Mg alloy in the melt to about 42% by weight.

It has been found, in a given instance, that the volume of the interstices of a batch of spherical Mg pellets, having a distribution of particle sizes within the range of about 8 mesh to about 100 mesh, is on the order of about 38%. If the interstitial volume is filled with molten salt having a specific gravity about equal that of molten Mg, then the salt comprises about 38% by weight (or by volume) of the total. Conversely, then, the Mg particles comprise about 62% by weight (or by volume) of the total. This fact is established by placing a batch of Mg particles in a graduated cylinder where the bulk volume can be easily read, then adding enough fluid to fill the interstitial volume to the top of the batch of Mg particles. Depending on the particle size distribution of the Mg particles, the volume of liquid required to fill the interstices may be a little more or a little less than 38%. It will be readily understood that the smaller Mg particles will lie in the interstices between much larger particles (conceptually, much like various-sized marbles among lemons and oranges), and this will have an effect on whether or not the interstitial volume of the mixture of particle sizes is more or less than 38%. Within the purview of the present inventive concept it is perceived that the interstitial volume in a quantity of Mg spheroidal globules will generally fall within the range of about 32% to about 42%, said volume being filled with the molten salt mixture. Conversely, then, the volume of the molten mixture (Mg and salt) which is filled with the Mg particles will generally fall within the range of about 58% to about 68%. Most usually, the volume of Mg particles in the molten mixture will comprise about 62%±2% of the total volume.

Using, e.g., the above-stated amount of 62% by volume (or by weight if the specific gravity of the molten salt is quite close to that of the Mg), then it is readily seen that an improvement in the process shown in U.S. Pat. No. 4,186,000 is obtained. In the stated patent the amount of salt which is removed to free the salt-coated Mg particles from entrapment is a much greater amount than in the present invention. The present invention, then, provides a means whereby a given charge of ingredients through the melting, cooling, and grinding operation yields a greater amount of salt-coated granules and a lesser amount of separated, pulverized salt. This also reduces the amount and expense of handling the separated, pulverized salt, whether it is recycled back to the melting operation or taken to some other operation. Considerable savings in the heat load (energy) are obtained.

Referring to the attached FIGURE which depicts a flow diagram, molten salt from vessel (1) and molten Mg or Mg alloy from vessel (2) are simultaneously and continuously fed, in pre-determined quantities, to mixer (3) where the mixture is well-mixed to cause dispersion of the molten Mg or Mg alloy as molten globules or granules in the molten salt. Control of the particle size range can be maintained in accordance with known methods (such as disclosed in U.S. Pat. No. 4,186,000; U.S. Pat. No. 4,279,641; and U.S. Pat. No. 4,182,498). From the mixer (3) the molten mixture is continuously taken directly to a chilling step, such as to a chilled rotating surface (4) where the mixture is laid down as a relatively thin sheet or ribbon and caused to chill rapidly to avoid any substantial amount of coalescence or clustering of the Mg globules. The frozen mixture is continuously and conveniently scraped from the chilled surface (4) by use of a scraper device (5) which also breaks up the brittle salt matrix into sizes which are readily received in a mill (6), such as a hammer-mill, and there it is broken into smaller pieces. From mill (6) the broken material is taken through a gentle-grinding mill (7) to complete the pulverization of the salt matrix and free the Mg from entrapment in the salt matrix. This gentle grinding substantially removes the salt encrustation from the Mg granules except for a relatively thin, tightly-bound surface layer, and does it in a manner in which there is no substantial amount of flattening, crushing, or breaking of the Mg granules. The thin salt-coating remaining on the Mg granules is, as shown in the patents mentioned supra, a beneficial feature.

A screening operation or other physical separation of the pulverized salt from the salt-coated Mg granules is easily accomplished. A screening operation can also serve as a shape classifier where any elongated granules are likely to be retained on a screen as the more spherical-shaped granules fall through.

Shape classification can also be accomplished by use of a slanted shaker-table such as described in U.S. Pat. No. 4,182,498.

It will be readily understood that the flow of salt and Mg or Mg alloy needs to be continuous only to the point at which the frozen mixture is taken from the chilling device. Once it is frozen, the possibility of coalescence or clustering of the Mg granules has ended. Thus the material can be taken through the grinding steps batchwise, if desired, by using a hold-up vessel or reservoir for the frozen material.

If the molten material is frozen into very thin layers, where the brittleness of the frozen salt matrix appears to be more pronounced, then it is possible to obtain enough fracturing by the action of the scraper so that the material can be taken directly to a final gentle-grinding mill without the need for an intermediate mill.

The flow of materials through the mixer is preferably done by having the outflow at a point distal from the inflow to assure good, thorough mixing in a uniform manner. The molten materials being fed to the mixer can be pre-mixed before entering the mixer or can be mixed within the mixer.

The following examples are provided for illustration purposes, but the invention is not limited to the particular embodiments shown.

EXAMPLE 1

In accordance with the present invention a supply of molten Mg and a supply of molten salt mix is provided. Flows of the molten material are fed uniformly and continuously to one end of a mixer at a ratio of about 1.63 parts molten Mg per 1 part of molten salt mix. The materials are uniformly mixed in the mixer and are continuously removed from the mixer onto a cool surface where freezing occurs rapidly. The frozen material is subjected to grinding which is gentle enough to pulverize the friable (brittle) salt matrix without crushing or distorting a substantial amount of the round Mg granules. The mixture is screened to separate the finely-divided salt and the Mg granules, still retaining a thin coating of tightly-bound salt, are retained on the screen. About 68 parts of salt-coated Mg granules are thus obtained for each 100 parts of total throughput, the salt-coating comprising about 8.8% of the total weight of the granules.

EXAMPLE 2

(prior art; for comparison)

Essentially in conformance with the prior art, a batch of molten material comprising about 42 parts of molten Mg and about 58 parts of molten salt, mixture is stirred in a mixing pot to obtain good dispersion of the Mg in the salt. The contents of the mixer are poured onto a cool surface and allowed to freeze. The frozen material is subjected to grinding as in Example 1 above and is screened to remove the finely-divided pulverized salt.

The salt-coated Mg granules retained on the screen are found to weigh about 46 parts, and the salt content of the granules is found to be about 8.7% by weight.

This prior art technique, then, is found to produce 46 parts of Mg granule product per 100 parts of throughput in comparison with the 68 parts of Mg granule product per 100 parts of throughput of Example 1 above.

EXAMPLE 3

Substantially in accordance with Example 1 above, various ratios of molten Mg and molten salt are used in a continuous operation through a stirred mixer. The material from the mixer is frozen, ground, and screened. The following Table I illustrates the data for Mg granule product.

TABLE I

| | Continuous Feed | | Product after |
|---|---|---|---|
| Run No. | Ratio Mg/salt | Parts of Mg per 100 parts total | Grinding/Screening % of Mg contained in 10 × 40 mesh fraction** |
| A | ~1.46 | 59.35 | 87.43 |
| B | ~1.39 | 58.24 | 89.78 |
| C* | ~4.53 | 81.92 | 44.49 |
| D | ~1.55 | 60.85 | 88.70 |
| E | ~1.39 | 58.11 | 90.11 |

*In Run C the high loading of Mg causes agglomerates which are too large to pass through the 10 mesh screen.
**Mesh sizes are U.S. Standard Sieve sizes.

The molten salt which is fed to the mixer along with molten Mg can be a freshly-prepared salt mixture, or can be a salt sludge or slag from a Mg-production or Mg-casting operation which already contains a relatively small amount of Mg. If the molten salt already contains some Mg or Mg alloy, then less additional Mg is needed to bring the Mg concentration in the mixer to the desired level.

The pulverized salt screenings from the present process can be recycled back to the molten salt feed, along with any Mg which may be in the screenings.

It is within the purview of the present invention that dispersing agents be provided in the molten mixture which aid in modifying or controlling the particle size range and distribution of the Mg globules in the mixer and to help in deterring the coalescence of particles during the casting and freezing step. Finely divided carbon and boron-containing compounds are known to be useful as dispersion agents. It has been found, surprisingly, that substantial amounts of alkaline earth metal oxides, e.g., MgO, have a beneficial effect as dispersion agents. When MgO is used as a dispersion agent, it should be substantially more than a trace amount and should preferably be as much as 4% or more of the molten salt mixture. A particularly effective range for the MgO dispersing agent is about 4% to about 15% of the molten salt mixture.

I claim:

1. A a process for preparing Mg or Mg alloy granules dispersed in a friable salt matrix, said process comprising continuously feeding to a mixer a molten flow of Mg or Mg alloy simultaneously with a molten flow of a salt mixture, the flow ratios of the molten materials being pre-determined to provide an amount up to about 68% of Mg or Mg alloy by volume in the mixture, thereby dispersing the molten Mg or Mg alloy as globules in the molten salt, continuously withdrawing from the mixer the molten salt having the molten Mg or Mg alloy dispersed therein, and quickly chilling the mixture to cause it to freeze thereby entrapping solid Mg or Mg alloy granules dispersed in a friable salt matrix.

2. The process of claim 1 wherein the frozen mixture is then subjected to sufficient milling to break up the friable salt matrix and free the Mg or Mg alloy granules entrapped therein.

3. The process of claim 1 wherein the frozen mixture is milled to pulverize the friable salt matrix whereafter the Mg or Mg alloy granules, still retaining a thin coating of salt on their surface, are separated from the pulverized salt.

4. The process of claim 1 wherein the frozen mixture is milled to pulverize the friable salt matrix and wherein the salt-coated granules of Mg or Mg alloy which thereby become freed from entrapment in the salt matrix are screened out of the pulverized salt.

5. The process of claim 1 wherein the mixer is an in-line static mixer.

6. The process of claim 1 wherein the mixer is an elongate intensive mixer with means for receiving the molten material at, or near, one end and means for discharging the molten material at, or near the other end.

7. The process of claim 1 wherein the amount of Mg or Mg alloy is in the range of about 58% to about 68%.

8. The process of claim 1 wherein the amount of Mg or Mg alloy is in the range of about 60% to about 64%.

9. The process of claim 1 wherein there is also provided, along with the molten flow to the mixer, at least one additional ingredient which aids in modifying or controlling the particle size range and distribution of the Mg or Mg alloy globules in the mixer.

10. The process of claim 1 wherein there is also provided, along with the molten flow to the mixer, at least one additive selected from the group comprising MgO, finely divided carbon and boron-containing compounds to serve as an aid in modifying or controlling the particle size range and distribution of the Mg or Mg alloy globules in the mixer.

11. The process of claim 1 wherein the molten salt comprises, predominantly, a mixture of alkali metal salts and alkaline earth metal salts.

12. The process of claim 11 wherein the salt mixture also contains minor amounts of metal oxides and/or contaminants.

13. In a process for preparing Mg or Mg alloy granules dispersed in a friable salt matrix by mixing molten salt and molten Mg or Mg alloy and then casting and freezing the mixture to obtain a frozen salt matrix having frozen Mg or Mg alloy granules dispersed therein, the improvement which comprises continuously feeding to a mixer a molten flow of Mg or Mg alloy simultaneously with a molten flow of salt, the flow ratios of the molten materials being pre-determined to provide an amount of up to about 68% by volume of Mg or Mg alloy in the mixture, thereby dispersing the molten Mg or Mg alloy as globules in the molten salt, while continuously withdrawing the molten mixture from the mixer and quickly freezing the mixture, thereby entrapping solid Mg of Mg alloy granules dispersed in a friable salt matrix.

14. The process of claim 13 wherein the amount of Mg or Mg alloy is in the range of about 58% to about 68%.

15. The process of claim 13 wherein the amount of Mg or Mg alloy is in the range of about 60% to about 64%.

16. The process of claim 13 wherein the frozen mixture is milled to pulverize the friable salt matrix, whereafter the Mg or Mg alloy granules, still retaining a thin coating of salt on their surface, are separated from the pulverized salt.

17. The process of claim 13 wherein the molten salt comprises, predominantly, a mixture of alkali metal salts and alkaline earth metal salts.

18. The process of claim 13 wherein the salt mixture comprises, predominantly, a mixture of alkali metal salts and alkaline earth metal salts and also contains minor amounts of metal oxies and/or contaminants.

19. The process of claim 13 wherein there is also provided, along with the molten flow to the mixer, at least one additional ingredient which aids in modifying or controlling the particle size range and distribution of the Mg or Mg alloy globules in the mixer.

20. A process for preparing salt-coated Mg or Mg alloy granules, said process comprising continuously feeding to a mixer or a molten flow of Mg or Mg alloy simultaneously with a molten flow of a molten salt mixture comprising, predominantly, alkali metal salt and alkaline earth metal salt, the flow ratios of the molten materials being pre-determined to provide an amount up to about 68% of Mg or Mg alloy by volume in the mixer, the mixer serving to disperse the molten Mg or Mg alloy as globules in the molten salt, continuously withdrawing from the mixer, at a site distal from the site of the feed, the molten salt having the molten Mg or Mg alloy dispersed therein, freezing the so-withdrawn molten mixture quickly enough to substantially avoid coalescence of dispersed Mg or Mg alloy globules, milling the frozen mixture to pulverize the friable salt matrix to free the Mg or Mg alloy particles from entrapment therein, the Mg or Mg alloy particles still retaining a thin, tightly-bound coating of the salt thereon, and separating the pulverized salt matrix from the so-formed salt-coated Mg or Mg alloy particles.

* * * * *

UNITED STATES PATENT AND TRADEMARK OFFICE

CERTIFICATE OF CORRECTION

PATENT NO. : 4,410,356

DATED : Oct. 18, 1983

INVENTOR(S) : Edward J. Skach, Jr.

It is certified that error appears in the above—identified patent and that said Letters Patent is hereby corrected as shown below:

Col. 4, line 63, "salt," should read -- salt --.

Col. 5, line 59, "a" should be deleted.

Col. 7, line 16, "oxies" should read -- oxides --.

Col. 8, line 1, "or" should be deleted.

Signed and Sealed this

*Twentieth* Day of *March 1984*

[SEAL]

*Attest:*

GERALD J. MOSSINGHOFF

*Attesting Officer*

*Commissioner of Patents and Trademarks*